US005753605A

United States Patent [19]

Blatter et al.

[11] Patent Number: 5,753,605

[45] Date of Patent: May 19, 1998

[54] HIGH TEMPERATURE FLASH POINT STABLE MICROEMULSION CLEANING COMPOSITION

[75] Inventors: Ewald R. Blatter, Henrietta; Daniel M. McBride, Sr.; Michael P. D'Ambrosio, both of Rochester; Howard E. Behrns, Pittsford; David J. Knapp, Rochester, all of N.Y.

[73] Assignee: Finger Lakes Chemical, Inc., Rochester, N.Y.

[21] Appl. No.: 628,292

[22] Filed: Apr. 5, 1996

[51] Int. Cl.[6] ..... C11D 9/26; C11D 9/24; C11D 9/10

[52] U.S. Cl. ..... 510/299; 510/342; 510/348; 510/360

[58] Field of Search ..... 252/106, 162; 106/287.24; 150/299

[56] References Cited

U.S. PATENT DOCUMENTS

| | | | |
|---|---|---|---|
| 4,540,505 | 9/1985 | Frazier | 252/106 |
| 5,112,516 | 5/1992 | Koetzle | 252/162 |
| 5,145,523 | 9/1992 | Halpin et al. | 134/40 |
| 5,213,624 | 5/1993 | Williams | 134/40 |
| 5,227,085 | 7/1993 | Motsenbocker | 252/99 |
| 5,306,444 | 4/1994 | Kitamura et al. | 252/546 |
| 5,393,451 | 2/1995 | Koetzle | 252/170 |
| 5,401,326 | 3/1995 | Mihelic et al. | 134/40 |
| 5,415,812 | 5/1995 | Durbut et al. | 252/547 |
| 5,437,808 | 8/1995 | Weltman et al. | 252/170 |
| 5,462,690 | 10/1995 | Rhinesmith | 252/126 |

*Primary Examiner*—John M. Ford
*Assistant Examiner*—Pavanaram K. Sripada
*Attorney, Agent, or Firm*—Cumpston & Shaw

[57] ABSTRACT

A microemulsion cleaning composition comprising four principle components are described. These four components are a terpene alcohol, an ether carboxylate surfactant, a aliphatic glycol ether cosolvent, and water. The cleaning composition may be used in a liquid form or an aerosol form. The composition is also included as an integral component of a cleaning kit.

21 Claims, No Drawings

HIGH TEMPERATURE FLASH POINT STABLE MICROEMULSION CLEANING COMPOSITION

FIELD OF INVENTION

The present invention relates to microemulsion cleaning compositions, and the use of such compositions in cleaning applications. More particularly, the present invention relates to an aerosolized microemulsion cleaning composition having a high temperature flash point.

BACKGROUND OF THE INVENTION

The present invention relates to organic cleaning formulations for removing soils from surfaces. A number of cleaning formulations have been used to remove soils from a variety of surfaces. The following information refers to Table I, a list of prior art cleaning formulations commercially available by others. The Table identifies the disadvantages inherent to each of these prior art formulations. Of the two abbreviations used in Table I, MEK is the abbreviation for methyl ethyl ketone and MIBK is the abbreviation for methyl isobutyl ketone.

Analysis of Table I illustrates that of the 17 prior art formulations listed, 13 contain ingredients which are being phased out due to Federal environmental regulations; 12 are toxic; 9 are flammable; 9 have strong odors; and 3 are not efficient cleaners for a wide class of soils. All of the 17 prior art formulations consist of at least one of these disadvantages, if not more.

Previously, many industrial process cleaning compositions were based on fluorinated/chlorinated solvents. However, as ecological concerns have risen in subsequent years, the search for more innocuous replacements for such cleaners has gained significant accountability. Safety concerns have also led to several modifications of cleaning composition requirements, including nontoxicity and high flash points.

A major disadvantage of present solvent based cleaners is their relatively low flash points, which can be unsafe when the cleaners are utilized for cleaning hot equipment or used in any restricted air space. It has been the custom to employ cleaning compositions based primarily upon the use of petroleum derived hydrocarbon solvents, such as methylene chloride, chloroform and CFC solvents. While these solvents are effective for the purposes for which they have been developed, they have become environmentally undesirable.

For example, in the automobile industry such cleaning compositions are necessary to remove soils such as dirt, grease, oils and other debris. The traditional chlorinated solvents such as methylene chloride, perchloroethane and 1,1,1-trichloroethane are suspected carcinogens and are being progressively phased out of the composition process within the industry. These chlorinated solvents cannot be recycled with the waste oil, thereby creating more hazardous waste. Solvents such as methanol and hexane are being used as substitutes for removing the debris from automotive parts and other metal objects. However, their low flash points and thus high evaporation rate pose health and safety risks to workers. The EPA and OSHA agencies deemed it hazardous to inhale the dust from the rapid evaporation of such solvents. As a result, the governmental agencies require slowly evaporating solvents to be used in the cleaning of these metal parts. The minimum flash point temperature for cleaning solvents is recommended to be 140 degrees Fahrenheit. At the present time, there is no effective cleaner for soils which possesses a high flash point, a low evaporation rate, relatively safe handling requirements, and which passes all the government regulations concerning air quality control.

Therefore, it is an object of this invention to provide a new organic solvent mixture cleaning solution which is particularly useful for removing soils from surfaces, has a relatively high flash point, a low toxicity, a low enough evaporation rate to reduce volatile emissions to the atmosphere and which conforms to Federal environmental regulations.

TABLE I

Organic Solvent Cleaning Formulations-Prior Art

| COMPONENTS | DISADVANTAGE |
|---|---|
| xylene, isopropyl alcohol, normal propyl alcohol, propylene glycol methyl ether, MIBK, methyl propyl ketone, butyl acetate | flammable, toxic, strong odor, subject to government initiated phase out |
| MEK, MIBK, isopropyl alcohol, toluene | flammable, toxic, subject to government initiated phase out |
| MEK, MIBK | flammable, toxic, strong odor, subject to government initiated phase out |
| MEK, toluene, isopropyl alcohol | flammable, toxic, strong odor, subject to government initiated phase out |
| MEK, toluene, isopropyl alcohol, naphtha, butyl acetate | flammable, toxic, strong odor, subject to government initiated phase out |
| MEK, toluene | flammable, toxic, strong odor, subject to government initiated phase out |
| naphtha, cyclohexene | strong odor |
| oxy-alcohol branched esters | toxic, subject to government initiated phase out |
| MEK, isopropyl alcohol, toluene, butyl acetate, water | flammable, toxic, strong odor, subject to government initiated phase out |
| naphtha, ethyl acetate, MIBK, isopropyl alcohol, toluene | flammable, toxic, strong odor, subject to government initiated phase out |
| MIBK, MEK | flammable, toxic, strong odor, subject to government initiated phase out |
| MEK | inefficient cleaner, residue |
| naphtha | inefficient cleaner, residue |
| ethyl ethoxypropianate | inefficient cleaner |
| aromatic naphthas | residue |
| MEK, ethanoline, proprietary ingredients | toxic, subject to government initiated phase out |
| 1-1-1-trichloroethane (methyl chloroform) | toxic, subject to government initiated phase out |
| trichloro-trifluoro-ethane (CFC-113) | subject to government initiated phase out |

SUMMARY OF THE INVENTION

The present invention relates to a cleaning composition comprising from less than 1 to about 20 percent of a terpene alcohol; from less than 1 to about 20 weight percent of an ether carboxylate surfactant; from about 5 to 35 weight percent of an ether co-solvent mixture; and the balance water. Further, the present invention encompasses a cleaning kit which includes the aforementioned cleaning composition and in addition an absorptive drop cloth; a plurality of disposable cloths, rags or cellulose products; and a container bag.

DETAILED DESCRIPTION OF THE INVENTION

The present invention relates to improved cleaning compositions which provides sufficient cleaning while conforming to governmental regulations.

The cleaning compositions of the present invention are in the form of microemulsions. Microemulsions are two phase mixtures comprising an oil phase and a water phase. Regular emulsions appear cloudy or opaque because the size of the droplets of oil are larger than quarter wavelengths of white light, and thus scatter light rather than allow it to pass through the mixture unscattered. Microemulsions have oil droplets less than about 10 microns in size and thus do not scatter light. Furthermore, microemulsions tend to be much more stable than regular emulsions. True microemulsions are easier to form from their constituent components than regular emulsions. Typically, emulsions may need special equipment to be formed such as ultrasonic mixers, or emulsifiers which produce tremendous shear forces. The compositions of the present invention require only standard, non-shear mixing apparatus to be produced.

Generally the cleaning composition comprises from less than 1 to about 20 weight percent of a terpene alcohol solvent; from less than 1 to about 20 weight percent of an ether carboxylate surfactant; from about 5 to 35 weight percent of an ether co-solvent mixture; and the balance is water. The cleaning composition may be available in a liquid or a pump spray application. However, it is preferred that the cleaning composition is available in an aerosolized form, preferably pressurized with a nonflammable gas sufficient to propel the composition from its container.

The term "terpene alcohol" is understood for purposes of the present invention to encompass compounds which are monocyclic, bicyclic and acyclic alcohols, respectively. Terpene alcohols are structurally similar to terpene hydrocarbons except that the structures also include some hydroxy functionality. They can be primary, secondary, or tertiary alcohol derivatives of monocyclic, bicyclic or acyclic terpenes as well as the above. Such tertiary alcohols include terpineol which is usually sold commercially as a mixture of alpha, beta, and gamma isomers. Linalool is also a commercially available tertiary terpene alcohol. Secondary alcohols include bormeol, and primary terpene alcohols include geraniol. Terpene alcohols are generally available through commercial sources, however, one must take care in practicing this invention to insure that no significant amount of alpha pinene or beta pinene are present in the terpene alcohol source, or that care is taken to remove such pinenes. Preferably, the terpene alcohol source used in this invention is commercially available under the name Tarksol 97, from Terpene Technologies of Rochester, N.Y. The relative amount of terpene alcohol present in the cleaning composition is from less than 1 to 15 weight percent. Preferably, the cleaning composition will contain less than 5 weight percent of the terpene alcohol source.

For purposes of this application, terpene hydrocarbon shall be understood to include all compounds which are monocyclic terpenes and acyclic terpenes. The terpene hydrocarbons used in the present invention are derived from a number of natural sources. Typically, the terpene hydrocarbon is a blend of naturally occurring terpene compounds. These compounds include the class of mono-or sesquiterpenes and mixtures thereof and can be acyclic or monocyclic in structure. Acyclic terpene hydrocarbons useful in the present invention include 2-methyl-6methylene-2,7-octadiene and 2,6-dimethyl-2,4,6 octadiene. Monocylic terpene hydrocarbons include terpinene, terpinolene and limonene classes and dipentene. While the examples provided here employ naturally occurring mixtures of these compounds it is understood that pure samples of these compounds could be employed as well. When refined samples of naturally occurring terpene hydrocarbons are employed, care must be taken to insure that no significant amount of alpha or beta pinene are present, or that any alpha or beta pinene are removed by means of distillation or filtering.

Specifically excluded from the term "terpene hydrocarbon" are bicyclic terpenes which include alpha and beta pinene.

Another major component of the microemulsion of the present invention is a lower alkyl monoether of a $C_2$ or $C_3$ aliphatic glycol e.g., ethylene glycol, diethylene glycol, propylene glycol and dipropylene glycol, or 1,5-dihydroxy-2-methyl pentane. This co-solvent material may be selected from materials represented in part by the following general formula 1, $$R_2O—(CH_2—CH(R_3)—O—)_z—(CH_2—CH(CH_3)—O—)_w—R_4$$

wherein $R_2$ is selected from the group consisting of a $C_1$–$C_7$ alkyl, $R_3$ is a hydrogen or methyl, $R_4$ is a $C_1$ to $C_7$ alkyl, w is 0 or 1, and z is a number from 1 to 2.

Examples of materials exemplified by general formula 1 that may be used to prepare the microemulsion of the present invention include, but are not limited to, the monomethyl ethers, monethyl ethers, monobutyl ethers, dimethyl ethers, and the phenyl ethers of monoethylene glycol, diethylene glycol, monopropylene glycol, and dipropylene glycol; the methyl, ethyl and butyl ethers of 2-ethoxy propanol; and the methyl ether of 1,5-dihydroxy-2-methyl pentane. Mixtures of such co-solvents may also be used.

The co-solvent component may be present in the range of from about 3 to about 45 weight percent, preferably in the approximate range of about 25 to 40 weight percent, e.g., approximately 35 weight percent. Typically the ether co-solvent is a mixture of less than 15 weight percent monomethyl ether of dipropylene glycol, less than 15 weight percent dimethyl ether of dipropylene glycol and less than 5 weight percent n-propyl ether of dipropylene glycol.

A further component of the microemulsion of the present invention is a ionic ether carboxylate represented by the following general formula 2, $$R—O—CH_2—CH_2—O—CH_2—COOHR_1$$

wherein R is $C_1$–$C_7$ alkyl and $R_1$ is an alkaline metal salt selected from the group sodium, lithium, or potassium. Examples of the ionic ether carboxylate surfactant that may be used is acetic acid, (2-butoxyethoxy)-sodium salt; acetic acid, (2-methoxyethoxy)-sodium salt; acetic acid, (ethoxyethoxy)-sodium salt; acetic acid, (propyolethoxy)-sodium salt; acetic acid, (2-pentoxyethoxy)-sodium salt; acetic acid, (2-hexoxyethoxy)-sodium salt; acetic acid (2-heptoxyethoxy)-sodium salt. Preferably the ionic ether carboxylate is acetic acid, (2-butoxyethoxy)-sodium salt. The sodium salt provides the best solubility and the least amount of residue. The ether carboxylate surfactant may be present in the approximate range from about 2 to about 20 weight percent, preferably in a range of less than 8 weight percent.

Another major ingredient of the microemulsion of the present invention is water. Ordinary tap water, usually of less than 150 p.p.m. hardness, as $CaCO_3$, distilled water or deionized water may be used. Preferably, demineralized water is used in the present invention to limit the amount of residue which remains on the cleaned parts. Water is used in the described and claimed concentrated microemulsions in amounts and quantities sufficient so that the total of all four major components adds to 100 percent.

Other suitable non-essential (non-major) ingredients that may be added to the microemulsion of the present invention to impart desirable properties include pH buffering materials such as alkali metal carbonates, bicarbonates, metalsilicates and orthophosphates, dyes, perfumes, enzymes and soil suspending agents such as carboxy methyl cellulose, rust inhibitors, defoamers, scale inhibitors, and preservatives. These ingredients may be added in amounts from 0 to about 20 parts by weight, based on 100 parts of the concentrated microemulsion. More typically, from about 5 to about 20, e.g., up to about 10 percent by weight of these additional ingredients or adjuvants may be incorporated into the microemulsion.

The microemulsions of the present invention possess properties that are particularly beneficial as cleaning compositions. As a microemulsion, the composition is clear and inherently stable. The microemulsion cleaning compositions of the present invention are highly effective in removing oils, particularly aliphatic and aromatic oils from hard surfaces, and have low VOC (volatile organic compound) values. In most cleaning applications using the microemulsion of the present invention, low foaming is experienced during the cleaning operation. Further, the microemulsion cleaning composition of the present invention is compatible with high soil loads, which suggests an extended bath life. The microemulsion compositions of the present invention are particularly useful for cleaning oily and greasy soils from substrates, e.g., hard surfaces.

The microemulsion cleaning compositions of the present invention possess a high flash point and a low evaporation rate. The cleaning compositions of the present invention possess a flashpoint in the approximate range of 140° Fahrenheit to approximately 180° Fahrenheit. Preferably, the flashpoint of the preferred embodiment of the present invention is 157° Fahrenheit, well above the government's current suggested minimum flashpoint of 140° Fahrenheit.

The microemulsion cleaning compositions of the present invention may be used in a wide variety of methods which will vary according to the amount of soil to be removed and the size and shape of the article to be cleaned. Applications of the cleaning composition can, for example, be by brushing, spraying, air or immersion dipping, hosing and wiping. Cleaning may be by batch or continuous methods. In a preferred form, the cleaning compositions of the present invention are pressurized with a non-flammable gas. The amount of pressure of the non-flammable gas is such that it will substantially propel the cleaning composition from its container, e.g., in the approximate range of 80 to 130 lbs. psi., more preferably, 110 lbs. psi. The non-flammable gas may be nitrous oxide or carbon dioxide or any other suitable gas, preferably carbon dioxide.

The cleaning composition of the present invention may also be useful without a presence of a terpene hydrocarbon solvent. However, a more effective cleaning results with the presence of the terpene hydrocarbon solvent.

The present invention is more particularly described in the following example, which is intended as illustrative only, since numerous modifications and variations therein will be apparent to one skilled in the art.

EXAMPLE

A concentrated microemulsion cleaning solution was prepared by mixing the following organic ingredients and then adding water:

| | |
|---|---|
| Tarksol 97 | less than 8 weight percent |
| Acetic Acid, (2-butoxyethoxy)-sodium salt | less than 8 weight percent |
| Dipropylene glycol monomethyl ether | less than 15 weight percent |
| Dipropylene glycol methyl ether | Less than 15 weight percent |
| Dipropylene glycol n-propyl ether | less than 5 weight percent |

The solution was mixed and then pressurized with 110 lbs. psi. of carbon dioxide. The cleaning composition was then sprayed onto automotive brake parts using an aerosol sprayer. The cleaning composition does not have to be in an aerosol form. The cleaning composition may be applied by direct application, pump spray or other suitable means. After an approximate time of 5 minutes of the cleaning composition being in contact with the metal parts, the cleaning composition and the debris on the metal parts were effectively wiped off with a cleaning cloth, rag, or other cellulose product. Upon wiping the metal parts, substantially all the debris was removed and very little residue remained on the metal parts.

Preferably, the cleaning composition is available as a substantial component of a cleaning kit. The cleaning kit comprises the aforementioned cleaning compositions, an absorptive drop cloth, a plurality of disposable cloths, rags or cellulose products, and a container bag. The drop cloth is selected to exhibit a greater absorptive capacity than the amount of cleaning composition in the kit. The cleaning kit is preferably used by positioning the sheet material or drop cloth beneath the metal parts; then contacting the metal parts with the aforementioned cleaning compositions for a time and temperature sufficient to remove debris from the surface of the parts; wiping the parts to remove the debris and the cleaning composition from the parts; and depositing the sheet material and rags in a container bag. The container bag may then be sealed to prevent any unintentional removal of the contents.

Although the present invention has been described with reference to these specific details of certain embodiments thereof, it is not intended that such details should be regarded as limitations upon the scope of the invention except as and to the extent that they are included in the accompanying claims.

What is claimed is:

1. A cleaning composition comprising:

(a) from less than 1 to about 20 weight percent of a terpene alcohol;

(b) from about 2 to about 20 weight percent of an ionic ether carboxylate surfactant represented by the general formula, $$R—O—CH_2—CH_2—O—CH_2COOHR_1,$$

wherein R is $C_1$–$C_7$ alkyl and $R_1$ is an alkaline metal salt;

(c) from about 3 to 35 weight percent of an ether co-solvent mixture represented by the general formula, $$R_2O—(—CH_2—CH(R_3)—O—)_z—(CH_2—CH(CH_3)—O—)_w—R_4$$

wherein $R_2$ is selected from the group consisting of a $C_1$–$C_7$ alkyl, $R_3$ is a hydrogen or methyl, $R_4$ is $C_1$–$C_7$ alkyl, w is 0 or 1, and z is a number from 1 to 2; and (d) water.

2. The cleaning composition as defined by claim 1 wherein the cleaning composition comprises less than 5 weight percent terpene alcohol, wherein the terpene alcohol contains no significant amount of alpha pinene or beta pinene.

3. The cleaning composition as defined in claim 1 wherein the ether carboxylate surfactant is an ionic ether carboxylate wherein R is $C_4$ and $R_1$ is Na; and the ether co-solvent is one wherein $R_2$ and $R_3$ are methyl when $R_4$ is hydrogen or methyl, or $R_2$ is n-propyl provided that $R_3$ is methyl and $R_4$ is hydrogen.

4. The cleaning composition as defined in claim 1 wherein the ether carboxylate is acetic acid, (2-butoxyethoxy)-sodium salt, and the ether co-solvent is a mixture of the monomethyl ether of dipropylene glycol, the dimethyl ether of dipropylene glycol, and the n-propyl ether of dipropylene glycol.

5. The cleaning composition as defined in claim 1 wherein the non-flammable pressurizing gas is carbon dioxide.

6. The cleaning composition as defined in claim 1 wherein the water is demineralized.

7. A cleaning composition comprising:

(a) from less than 1 to about 20 weight percent of a terpene alcohol;

(b) from less than 1 to about 20 weight percent of an ionic ether carboxylate surfactant represented by the general formula, $$R—O—CH_2—CH_2—O—CH_2COOHR_1,$$

wherein R is $C_1$–$C_7$ alkyl and $R_1$ is an alkaline metal salt;

(c) from about 5 to 35 weight percent of an ether co-solvent mixture represented by the general formula, $$R_2O—(—CH_2—CH(R_3)—O—)_z—(CH_2—CH(CH_3)—O—)_w—R_4$$

wherein $R_2$ is selected from the group consisting of a $C_1$–$C_7$ alkyl, $R_3$ is a hydrogen or methyl, $R_4$ is $C_1$–$C_7$ alkyl, w is 0 or 1, and z is a number from 1 to 2;

(d) water; and (e) a nonflammable pressurizing gas sufficient to propel the composition.

8. The cleaning composition as defined by claim 7 wherein the cleaning composition comprises less than 5 weight percent terpene alcohol, wherein the terpene alcohol contains no significant amount of alpha pinene or beta pinene.

9. The cleaning composition as defined in claim 7 wherein the ether carboxylate is less than 8 weight percent acetic acid, (2-butoxyethoxy)-sodium salt, and the ether co-solvent is a mixture of less than 15 weight percent monomethyl ether of dipropylene glycol, less than 15 weight percent dimethyl ether of dipropylene glycol, and less than 5 weight percent n-propyl ether of dipropylene glycol.

10. The cleaning composition as defined in claim 7 wherein the non-flammable gas is carbon dioxide.

11. The cleaning composition as defined in claim 7 wherein the water is demineralized.

12. A cleaning composition comprising:

(a) from less than 1 to about 15 weight percent of a terpene alcohol;

(b) from about 2 to about 20 weight percent of an ionic ether carboxylate surfactant represented by the general formula, $$R—O—CH_2—CH_2—O—CH_2COOHR_1,$$

wherein R is $C_1$–$C_7$ alkyl and $R_1$ is an alkaline metal salt;

(c) from about 3 to about 45 weight percent of an ether co-solvent mixture represented by the general formula, $$R_2O—(—CH_2—CH(R_3)—O—)_z—(CH_2—CH(CH_3)—O—)_w—R_4$$

wherein $R_2$ is selected from the group consisting of a $C_1$–$C_7$ alkyl, $R_3$ is a hydrogen or methyl, $R_4$ is $C_1$–$C_7$ alkyl, w is 0 or 1, and z is a number from 1 to 2;

(d) water; and (e) a nonflammable pressurizing gas.

13. The cleaning composition as defined by claim 12 wherein the cleaning composition comprises less than 5 weight percent terpene alcohol, wherein the terpene alcohol contains no significant amount of alpha pinene or beta pinene.

14. The cleaning composition as defined in claim 12 wherein the ether carboxylate is less than 8 weight percent acetic acid, (2-butoxyethoxy)-sodium salt, and the ether co-solvent is a mixture of less than 15 weight percent monomethyl ether of dipropylene glycol, less than 15 weight percent dimethyl ether of dipropylene glycol, and less than 5 weight percent n-propyl ether of dipropylene glycol.

15. The cleaning composition as defined in claim 1 wherein the water is demineralized.

16. The cleaning composition as defined in claim 1 further comprising a non-flammable pressurizing gas sufficient to propel the chemical composition.

17. The nonflammable pressurizing gas as defined in claim 16 is carbon dioxide.

18. The cleaning composition as defined in claim 12 having a flashpoint of 157° Fahrenheit.

19. A cleaning kit comprising:

(a) from less than 1 to about 20 weight percent of a terpene alcohol;

(b) from about 1 to about 20 weight percent of an ionic ether carboxylate surfactant represented by the general formula, $$R—O—CH_2—CH_2—O—CH_2COOHR_1,$$

wherein R is $C_1$–$C_7$ alkyl and $R_1$ is an alkaline metal salt;

(c) from about 3 to 45 weight percent of an ether co-solvent mixture represented by the general formula, $$R_2O—(—CH_2—CH(R_3)—O—)_z—(CH_2—CH(CH_3)—O—)_w—R_4$$

wherein $R_2$ is selected from the group consisting of a $C_1$–$C_7$ alkyl, $R_3$ is a hydrogen or methyl, $R_4$ is $C_1$–$C_7$ alkyl, w is 0 or 1, and z is a number from 1 to 2; and (d) water;

(e) an absorptive drop cloth;

(f) a plurality of disposable cloths, rags or cellulose products; and (g) a container bag.

20. A method of cleaning metal parts, comprising positioning a sheet material beneath the metal parts; contacting the metal parts with the cleaning composition comprising:

(a) from less than 1 to about 20 weight percent of a terpene alcohol;

(b) from about 1 to about 20 weight percent of an ionic ether carboxylate surfactant represented by the general formula, $$R—O—CH_2—CH_2—O—CH_2COOHR_1,$$

wherein R is $C_1$–$C_7$ alkyl and $R_1$ is an alkaline metal salt;

(c) from about 3 to 45 weight percent of an ether co-solvent mixture represented by the general formula, $$R_2O—(—CH_2—CH(R_3)—O—)_z—(CH_2—CH(CH_3)—O—)_w—R_4$$

wherein $R_2$ is selected from the group consisting of a $C_1$–$C_7$ alkyl, $R_3$ is a hydrogen or methyl, $R_4$ is $C_1$–$C_7$ alkyl, w is 0 or 1, and z is a number from 1 to 2; and (d) water;

(e) for a time and temperature sufficient to remove debris from the surface of the parts;

(f) wiping the parts to remove the debris and the cleaning composition from the parts;

(g) depositing the sheet material in a container bag; and (h) sealing the container bag.

21. The method as defined in claim 20 wherein the time is from about 1 to 5 minutes.

* * * * *